US007319202B2

(12) United States Patent
Sato

(10) Patent No.: US 7,319,202 B2
(45) Date of Patent: Jan. 15, 2008

(54) KEY SWITCH DEVICE

(75) Inventor: Tomio Sato, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 11/617,175

(22) Filed: Dec. 28, 2006

(65) Prior Publication Data

US 2007/0193869 A1 Aug. 23, 2007

(30) Foreign Application Priority Data

Feb. 21, 2006 (JP) ..... P2006-044233

(51) Int. Cl.
*H01H 13/70* (2006.01)

(52) U.S. Cl. ..... 200/344

(58) Field of Classification Search ..... 200/5 A, 200/517, 344, 345; 400/490, 491, 491.2, 400/495.1, 495, 496

See application file for complete search history.

(56) References Cited

U.S. PATENT DOCUMENTS 5,823,325 A * 10/1998 Lin ..... 200/344
6,020,566 A * 2/2000 Tsai ..... 200/344
6,056,459 A * 5/2000 Tsai ..... 200/344
6,100,482 A * 8/2000 Koma et al. ..... 200/344
6,399,909 B1 * 6/2002 Okada ..... 200/344
6,509,536 B2 * 1/2003 Sasaki ..... 200/344
6,713,699 B2 * 3/2004 Yoneyama ..... 200/344
6,723,935 B1 * 4/2004 Watanabe ..... 200/344
6,730,868 B1 * 5/2004 Watanabe ..... 200/344
7,094,984 B2 * 8/2006 Yokoyama ..... 200/344

FOREIGN PATENT DOCUMENTS

JP 2001-283675 10/2001

* cited by examiner

*Primary Examiner*—Michael A Friedhofer
(74) *Attorney, Agent, or Firm*—Whitham Curtis Christofferson & Cook, PC

(57) ABSTRACT

A first bearing member is provided on a key top. A second bearing member is provided on the key top. A first guide member is provided on a board. A second guide member is provided on the board. A first link member is disposed between the board and the key top, and has a first end portion rotatably supported by the first bearing member and a second end portion engaged with the first guide member. A second link member is disposed between the board and the key top, and has a third end portion rotatably supported by the second bearing member and a fourth end portion engaged with the second guide member. A third link member is disposed between the board and the key top. The first link member, the second link member, and the third link member are not in contact with each other. The second end portion is slidable relative to the first guide member in a first horizontal direction so that the first end portion is movable in a vertical direction. The fourth end portion is slidable relative to the second guide member in a second horizontal direction opposite to the first horizontal direction so that the third end portion is movable in the vertical direction. The first link member and the second link member are symmetrically arranged.

6 Claims, 5 Drawing Sheets

KEY SWITCH DEVICE

The disclosure of Japanese Patent Application No. 2006-044233 filed Feb. 21, 2006 including specification, drawings and claims is incorporated herein by reference in its entirety.

BACKGROUND

The present invention relates to a key switch device. More particularly, the present invention relates to a link-type key switch device suitably used for a slim keyboard of a notebook PC.

A related-art link-type key switch device is disclosed in Japanese Patent Publication No. 2001-283675A. As shown in FIG. 5, the related-art key switch device includes a board 1, a key top 2, a rubber spring 3 interposed between a board 1 and the key top 2, and a small link member 4 and a large link member 5 interposed between the board 1 and the key top 2. The rubber spring 3, the small link member 4, and the large link member 5 hold the key top 2 to allow the key top 2 to be movable up and down.

More specifically, the small link member 4 is made of a synthetic resin material. A lower end portion of the small link member is mounted on a slide guide (not shown) provided on the top surface of the board 1 so as to be slidable in a horizontal direction. A top shaft portion 7 is mounted on a bearing portion 8 provided on the rear surface of the key top 2 so as to be pivotable in a vertical direction. On the other hand, the large link member 5 is formed into a U-shape by bending a wire. An upper end portion of the large link member is mounted in a bearing portion 9 formed in the rear surface of the key top 2 so as to be pivotable in the vertical direction, and a lower end portion of the large link member is mounted in a bearing portion 10 formed on the top surface of the board 1 and the rear surface of the key top 2 so as to be pivotable in the vertical direction.

The key top 2 is held by a lifting mechanism including the small link member 4 and the large link member 5 and the rubber spring 3 so as to be movable up and down, thereby stably moving in a vertical stroke.

However, in a link mechanism of the related-art key switch device described above, the upper end portion of the large link member 5 is connected to the bearing portion 9 of a key top 2 so as to be pivotable in the vertical direction. And the lower end portion of the large link member 5 is connected to the bearing portion 10 of a board 1 so as to be pivotable in the vertical direction. With this structure, since the large link member 5 pivots about the bearing portion 10 of the board 1 in the vertical direction, the large link member 5 does not move directly downwards, but it moves in a horizontal direction by an interval D when the key top 2 is depressed. Accordingly, since at least the interval D must be secured as a gap between the key tops, a loss occurs when a plurality of key tops is arranged.

Furthermore, in the related-art key switch device, since only one small link member 4 is provided on one side of the key top 2, a wobbling in a sliding direction and a wobbling in a rotation direction of the key top 2 are easy to occur. Therefore, the wobbling deteriorates the touch of a key. In addition, in the related-art key switch device, the holding force of the key top decreases and the key top may be easily removed.

SUMMARY

It is therefore an object of the invention to provide a key switch device where the key top can smoothly move directly downward, the wobbling of the key top can be removed, and the holding force of the key top can be increased when the key top is depressed.

In order to achieve the above described object, according to the invention, there is provided a key switch device, comprising:

a board;

a key top;

a first bearing member provided on the key top;

a second bearing member provided on the key top;

a first guide member provided on the board;

a second guide member provided on the board;

a first link member disposed between the board and the key top, and having a first end portion rotatably supported by the first bearing member and a second end portion engaged with the first guide member;

a second link member disposed between the board and the key top, and having a third end portion rotatably supported by the second bearing member and a fourth end portion engaged with the second guide member; and a third link member disposed between the board and the key top, wherein:

the first link member, the second link member, and the third link member are not in contact with each other;

the second end portion is slidable relative to the first guide member in a first horizontal direction so that the first end portion is movable in a vertical direction;

the fourth end portion is slidable relative to the second guide member in a second horizontal direction opposite to the first horizontal direction so that the third end portion is movable in the vertical direction; and the first link member and the second link member are symmetrically arranged.

With this configuration, when the key top is depressed, the first and the third end portions rotate in the first and the second bearing members. Simultaneously, the second and the fourth end portions slide relative to the first and the second guide members along a top surface of the board in the first and the second horizontal directions. Therefore, the key top is held by the first and the second link members while receiving an equal force from both sides of the key top. Then, the first and the second link members move so as to allow the key top to move directly downwards. On the other hand, when the depressing force is released, the key top moves directly upwards.

Since the first and the second link members are disposed symmetrically, it is possible to prevent the wobbling in the sliding direction and the wobbling in the rotation direction of the key top. In addition, the key top is held by a pair of the small link members, thereby increasing a force holding the key top.

Since a depressed key top moves directly downward, it is possible to increase a density by narrowing the gap between adjacent key tops. Therefore, it is possible to miniaturize the entirety of a keyboard. In addition, it is possible to increase the key top's own surface area by as much as the gap, even in the space of a same keyboard. Therefore, it is possible to improve operability by an operator by increasing the key top's own surface area.

Since it is possible to prevent the wobbling in the sliding direction and the rotation direction of the key top by using the first and the second link members and to perform a depressing operation of the key top smoothly, the touch of the key is improved and a high-quality operation feeling can be obtained.

Since the key top is held from both left and right sides by the first and the second link members, a force holding the key top may be increased.

The second end portion may be slidable in a direction opposite to the second link member in accordance with a movement of the key top member; and The fourth end portion may be slidable in a direction opposite to the first link member in accordance with the movement of the key top member.

With this configuration, when the key top is depressed, since the second and the fourth end portions of the first and the second link members slide opposite to each other, respectively, and the key top moves directly downwards by the movements of the first and the second link members, it is possible to obtain an effect that the key top can move more smoothly in the vertical direction.

The key switch device may further comprise:

a third bearing member provided on the board; and a third guide member provided on the key top, wherein:

the third link member has a fifth end portion rotatably supported by the third bearing member and a sixth end portion engaged with the third guide member; and the sixth end portion is slidable relative to the third guide member in a third horizontal direction perpendicular to the first horizontal direction and the second horizontal direction so that the fifth end portion is movable in the vertical direction.

With this configuration, when the key top is depressed, the fifth end portion rotates in the third bearing member and the sixth end portion slides relative to the guide portion along the top surface of the board, and the key top moves directly downwards. Accordingly, the depressed key top can move directly downwards with a guide by the first and the second link members and a guide by the third link member. In addition, it is possible to prevent the wobbling in the sliding direction and the wobbling in the rotation direction of the key top by the first and the second link members and the third link member and to increase the force holding the key top.

The third bearing member may be formed with a hole rotatably supporting the fifth end portion and a slit communicating with the hole so that the fifth end portion is press-fitted into the hole through the slit.

With this configuration, when a part of the third link member (fifth end portion) is strongly depressed to the slit, the part thereof is press-fitted into the hole of third bearing portion on the board, thereby connecting the third link member with the board.

Since it is possible to easily connect the third link member with the third bearing portion of the board, workability is improved at the time of assembling.

The key switch device may further comprise:

a first rib member supporting the third link member in the first horizontal direction; and a second rib member supporting the third link member in the second horizontal direction, wherein:

the first rib member and the second rib member clamp the third link member.

With this configuration, since the third link member is stably supported by the first rib and the second rib, the wobbling of the key top may be removed.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Hereinafter, an embodiment of a key switch device according to the invention will be discussed with reference to the accompanying drawings.

Figure 1A:
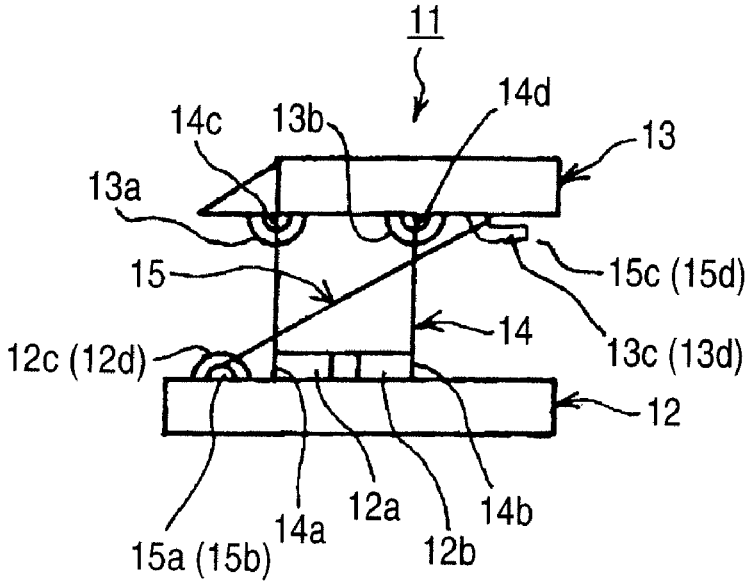
FIG. 1A is a schematic side view showing a key switch device according to an embodiment of the present invention.
Figure 1B:
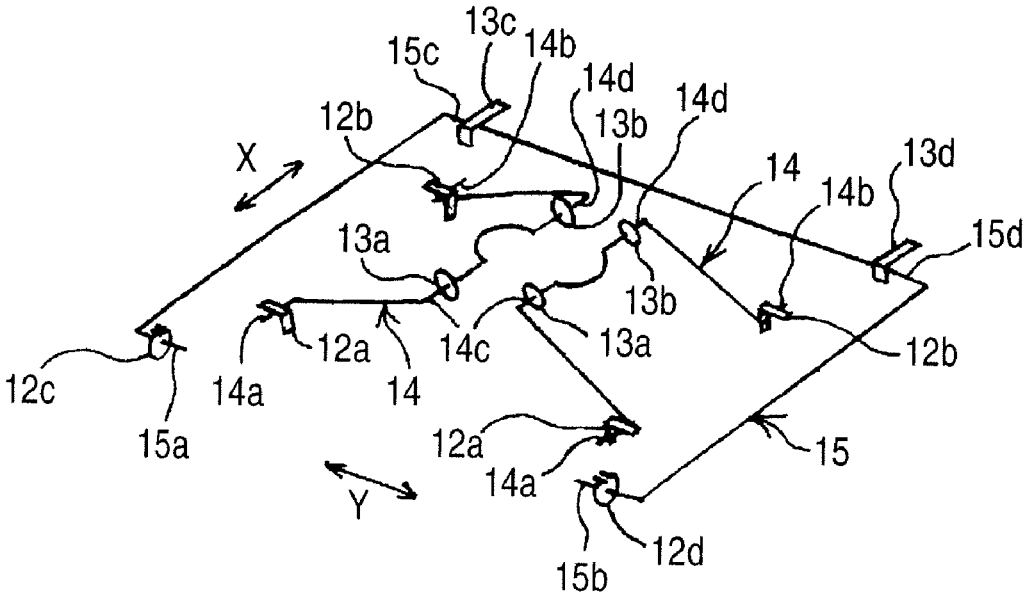
FIG. 1B is a schematic perspective view showing a small link member and a large link member according to the embodiment.

As shown in FIGS. 1A and 1B the key switch device 11 includes a board 12 and a key top 13 provided on the upper side of the board 12. A pair of symmetric small link members 14 and a large link member 15 disposed orthogonal to a pair of the small link members 14 on the outer side of a pair of the symmetrical small link members 14 are interposed between the board 12 and the key top 13 without contact with each other.

The small link members 14 have symmetrical shapes with each other, and are disposed in a symmetric pattern. As shown in FIG. 1B, the small link member 14 integrally includes slide portions 14*a* and 14*b* extending in an X direction as both lower end portions. The slide portions 14*a* and 14*b* are engaged with slide guides 12*a* and 12*b* of the board 12 to slide horizontally (Y direction indicated by an arrow shown in FIG. 1B) on the top surface of the board 12. Meanwhile, top surface of the small link member 14 includes rotary portions 14*c* and 14*d* in symmetric opposite portions the rotary portions 14*c* and 14*d* are supported by bearing portions 13*a* and 13*b* with slits provided in the rear surface of a key top 13 so as to be pivotable in vertical direction.

Meanwhile, as shown in FIG. 1B, the large link member 15 includes rotary portions 15*a* and 15*b* extending in a Y direction in both side portions of the lower end portions together. The rotary portions 15*a* and 15*b* are supported by bearing portions 12*c* and 12*d* with slits provided on the board 12 so as to be pivotable in vertical direction. Meanwhile, the upper end portion of the large link member 15 includes the slide portions 15*c* and 15*d* extending in the Y direction in both side portions of the upper end portion. In addition, the slide portions 15*c* and 15*d* are slidable horizontally (X direction indicated by an arrow shown in FIG. 1B) on the top surface of the board 12 and are engaged with slide guide 13*c* and 13*d* disposed in the rear surface of the key top 13.

Meanwhile, the rotary portions 15*a* and 15*b* of the large link member 15 are depressed to slits provided on the peripheral surfaces of the bearing portions 12*c* and 12*d* with slits. Then, the slits are temporarily expanded outwardly and the rotary portions 15*a* and 15*b* are press-fitted in holes of the bearing portions 12*c* and 12*d* with slits. In this mounting structure, the bearing portions 12*c* and 12*d* with slits on the board 12 are easily connected to the large link member 15, thereby improving workability at the time of assembling.

Figure 2:
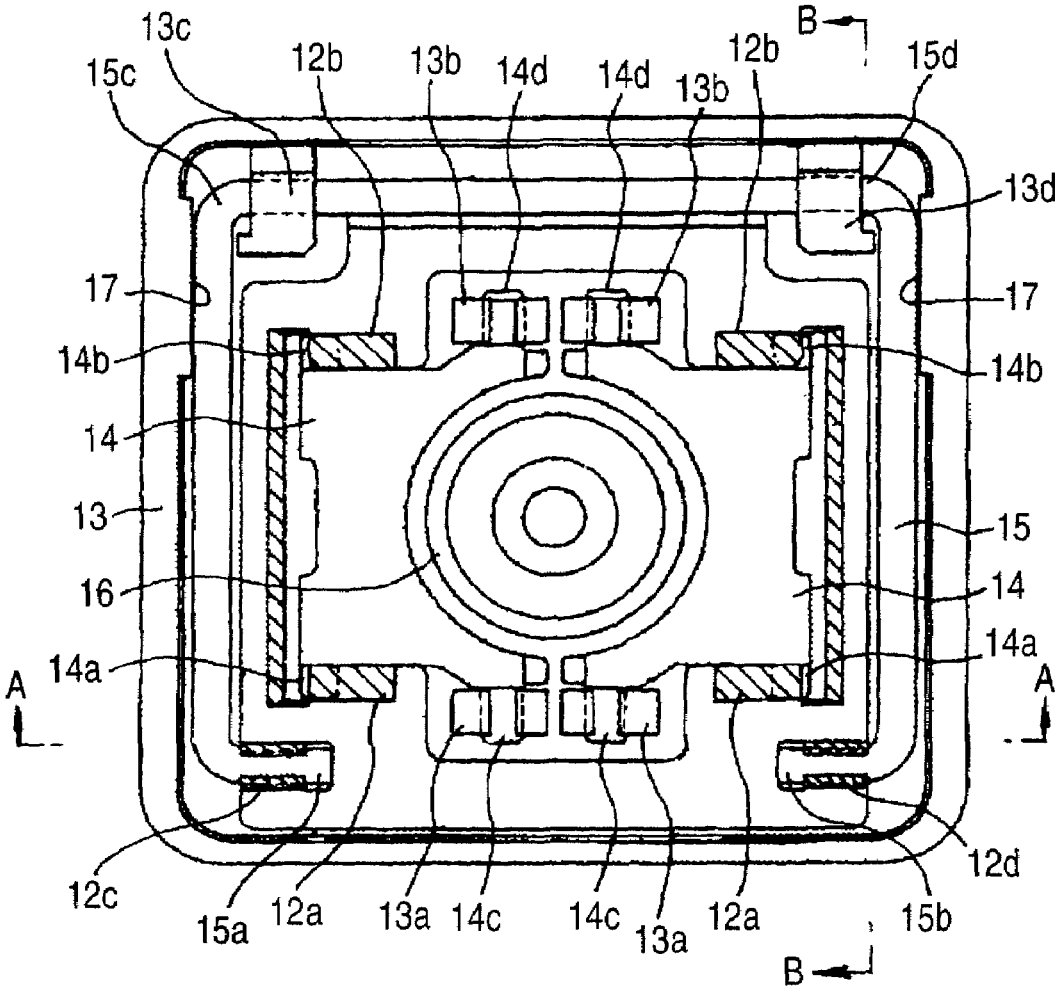
FIG. 2 is a section view of the key switch device according to the embodiment.

As shown in FIG. 2, in the center portion of the key switch device 11, a substantially dome-shaped rubber spring 16 is placed on a board 12. Ribs 17 and 17 protruding inwardly are provided on both left and right sides. The ribs 17 and 17 typically abut on both left and right sides of the large link member 15 and the large link member 15 is easily interposed between left and right directions of the key top 13. The wobbling is suppressed in left and right directions of the key top 13 by the abutment.

Figure 3A:
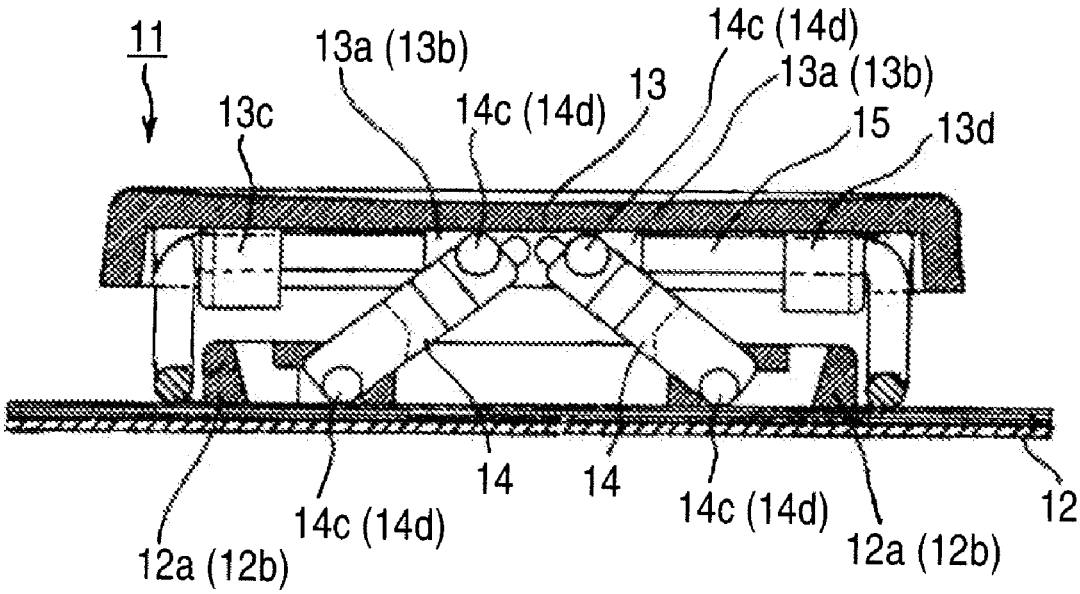
FIG. 3A is a section view of the key switch device taken along the line A-A shown in FIG. 2, showing a state where a key top is not depressed.
Figure 4A:
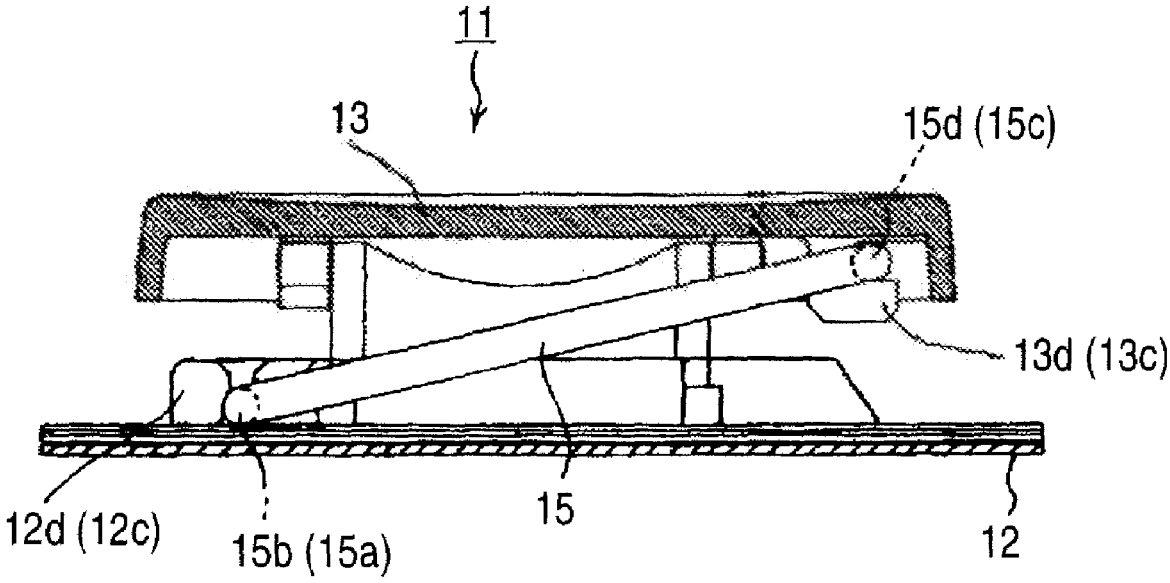
FIG. 4A is a section view of the key switch device taken along the line B-B shown in FIG. 2, showing a state where the key top is not depressed.

As shown in FIGS. 3A and 4A, before the key top 13 is depressed, the rubber spring 16 described above urges the key top 13 upwardly. Accordingly, the small link member 14 and the large link member 15 are raised at a predetermined angle relative to the board 12.

When the operator depresses the key top 13 in this state, the key top 13 depresses the rubber spring 16 so as to deform it and the small link member 14 and the large link member 15 are depressed down. At this moment, the small link members 14 pivots in directions reversal to each other. That is, the slide portions 14*a* and 14*b* at both lower ends of the small link member 14 slide relative to the slide guides 12*a* and 12*b* formed in the board 12 along the top surface of the board 12. In addition, the rotary portions 14*c* and 14*d* at both upper ends of the small link member 14 rotate inwardly in the bearing portions 13*a* and 13*b* with slits on the rear surface of the key top 13. The slide portions 14*a* and 14*b* at both lower ends of the other small link member 14 slide in an outer horizontal direction away from the one small link member 14 and the rubber spring 16 in the slide guides 12*a* and 12*b* along the top surface of the board 12. The rotary portions 14*c* and 14*d* at the upper ends of the small link member 14 rotate inwardly in the bearing portions 13*a* and 13*b* with slits on the rear surface of the key top 13*c*.

Meanwhile, the rotary portions 15*a* and 15*b* at the lower ends of the large link member 15 rotate in the bearing portions 12*c* and 12*d* with slit provided on the board 12. In addition, the rotary portions 15*c* and 15*d* at the upper ends of the large link member 15 slide outwardly in the slide guides 13*c* and 13*d* of the key top 13 along the top surface of the board 12.

Due to the linking action of the small link member 14 and the large link member 15, the key top 13 is depressed in the directly vertical direction in a state where the key top 13 is substantially in parallel with the board 12. When the key top 13 is depressed down to a predetermined position, the rubber spring 16 makes a switch member (not shown) provided on the board 12 turn on.

Figure 3B:
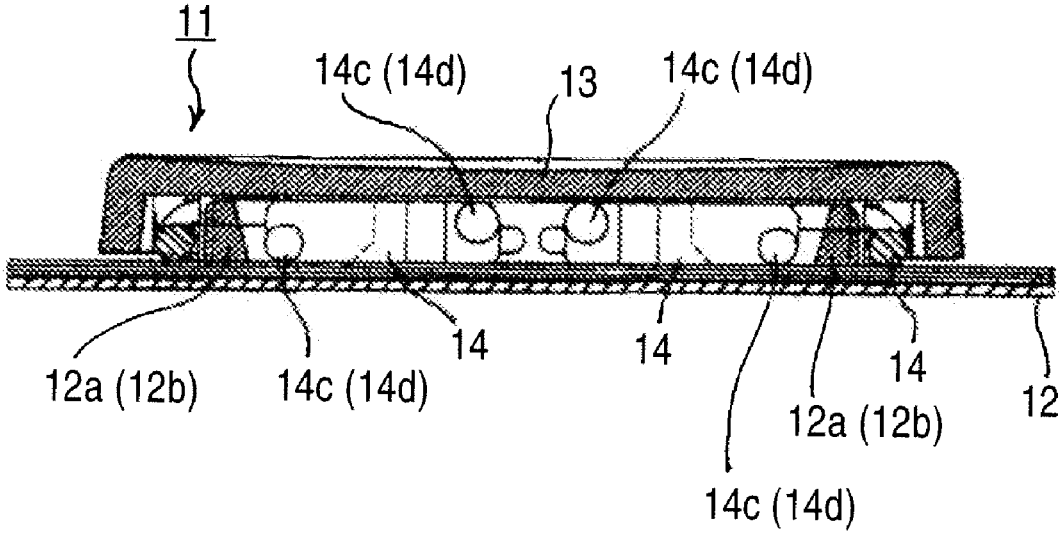
FIG. 3B is a section view of the key switch device taken along the line A-A shown in FIG. 2, showing a state where the key top is depressed.
Figure 4B:
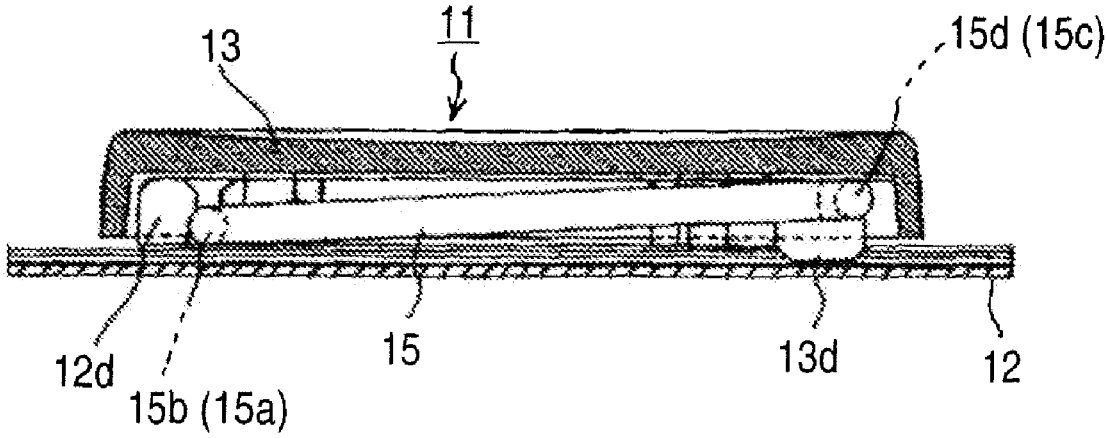
FIG. 4B is a section view of the key switch device taken along the line B-B shown in FIG. 2, showing a state where the key top is depressed.
Figure 5:
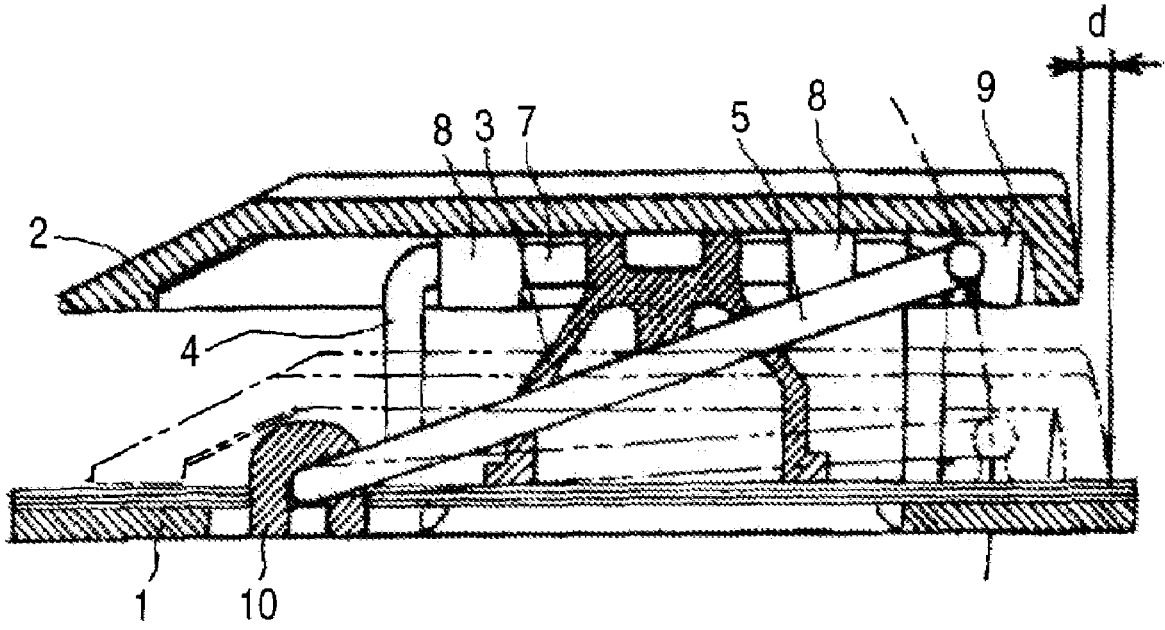
FIG. 5 is a section view of a related-art key switch device.

Further, as shown in FIGS. 3B and 4B, when the key top 13 is depressed down to the lowermost point, the bottom surface of the key top 13 comes into contact with the board 12. Accordingly, the key top is not depressed any more.

When the depressing force of the key top 13 is released, the key top 13, the small link members 14 and the large link members 15 are moved by a force of rubber spring 16 in a direction reversal to the direction at the time when depressed. Then, as shown in FIGS. 3A and 4A, the key top 13 returns to a predetermined position and makes the switching member turn off in the middle thereof.

As described above, in the structure of the key switch device according to the embodiment, when the key top 13 is depressed, the upper end portions of the small link member 14 rotate between the key top 13 and the board 12. Simultaneously, the lower end portions of the small link member 14 slide in the slide guides 12*a* and 12*b* in the horizontal direction along the top surface of the board 12. Since the small link members 14 are disposed symmetrically, the key top 13 is held by the small link members 14 while receiving an equivalent force from both left and right sides. And the key top 13 can move directly downwards. On the other hand, the rotary portions 15*a* and 15*b* which are the lower end portions of the large link member 15 rotate between the board 12 and the key top 13. Simultaneously, the slide portions 15*c* and 15*d* which are the upper end portions of the large link member 15 slide relative to the slide guides 13*c* and 13*d* in the horizontal direction. And the key top 13 can move directly downwards. Accordingly, the depressed key top 13 can move directly downwards by operations of the small link members 14 and the large link member 15. Therefore, it becomes possible to increase a density by narrowing the gap between the adjacent key tops 13, thereby miniaturizing the entirety of the keyboard.

It becomes possible to improve the operability of the operator by increasing the surface area of the key top 13 as large as the gap even in the space of a same keyboard 13.

It is possible to prevent the wobbling in the sliding direction and the rotation direction of the key top 13 by depressing of the small link members 14 and suppressing by the abutment between the ribs 17 provided on both left and right sides of the key top 13 and the large link member 15. Accordingly, it is possible to smoothly perform a depressing operation of the key top 13 smoothly, thereby improving the touch of the key and obtaining a high-quality operation feeling.

Since a pair of the small link members 14 and the large link member 15 are held in connection with the key top, the force holding the key top 13 increases. Therefore, it is possible to prevent the key top 13 from being improperly removed.

The invention can be modified in a variety of ways without departing from the spirit of the invention, and it is a matter of course that the invention encompasses the modified examples.

What is claimed is:

1. A key switch device, comprising:

a board;

a key top;

a first bearing member provided on the key top, having structure forming a respective first pair of bearing holes arranged coaxially and spaced apart in the axial direction;

a second bearing member provided on the key top, having structure forming a respective second pair of bearing holes arranged coaxially and spaced apart in the axial direction;

a first guide member provided on the board;

a second guide member provided on the board;

a first link member disposed between the board and the key top, and having a first end portion rotatably supported within the first pair of bearing holes, and a second end portion engaged with the first guide member;

a second link member disposed between the board and the key top, and having a third end portion rotatably supported within the second pair of bearing holes and a fourth end portion engaged with the second guide member; and a third link member disposed between the board and the key top, wherein:

the first link member, the second link member, and the third link member are not in contact with each other;

the second end portion is slidable relative to the first guide member in a first horizontal direction so that the first end portion is movable in a vertical direction;

the fourth end portion is slidable relative to the second guide member in a second horizontal direction opposite to the first horizontal direction so that the third end portion is movable in the vertical direction; and the first link member and the second link member are symmetrically arranged.

2. The key switch device as set forth in claim 1, wherein:

the second end portion is slidable in a direction opposite to the second link member in accordance with a movement of the key top member; and the fourth end portion is slidable in a direction opposite to the first link member in accordance with the movement of the key top member.

3. The key switch device as set forth in claim 1, further comprising:

a third bearing member provided on the board; and a third guide member provided on the key top, wherein:

the third link member has a fifth end portion rotatably supported by the third bearing member and a sixth end portion engaged with the third guide member; and the sixth end portion is slidable relative to the third guide member in a third horizontal direction perpendicular to the first horizontal direction and the second horizontal direction so that the fifth end portion is movable in the vertical direction.

4. The key switch device as set forth in claim 3, wherein:

the third bearing member is formed with a hole rotatably supporting the fifth end portion and a slit communicating with the hole, wherein the slit has a width smaller than a diameter of the fifth end portion to distort and widen when the fifth end portion is press-fitted into the hole through the slit and then narrow to said width restrain the fifth end portion within the hole.

5. The key switch device as set forth in claim 1, further comprising:

a first rib member supporting the third link member in the first horizontal direction; and a second rib member supporting the third link member in the second horizontal direction, wherein:

the first rib member and the second rib member are constructed and arranged to clamp the third link member.

6. The key switch device of claim 1, wherein:

the first bearing member has structure forming a first pair of slits communicating with the first pair of bearing holes, the first pair of slits having a width smaller than a diameter of the first end portion within the first pair of bearing holes, and the second bearing member has structure forming a second pair of slits communicating with the second pair of bearing holes, the second pair of slits having a width smaller than a diameter of the third end portion within the second pair of bearing holes.

* * * * *